US005657643A

United States Patent [19]

Price

[11] Patent Number: 5,657,643

[45] Date of Patent: Aug. 19, 1997

[54] CLOSED LOOP SINGLE MIXED REFRIGERANT PROCESS

[75] Inventor: Brian C. Price, Overland Park, Kans.

[73] Assignee: The Pritchard Corporation, Overland Park, Kans.

[21] Appl. No.: 607,942

[22] Filed: Feb. 28, 1996

[51] Int. Cl.[6] ..... F25J 3/00

[52] U.S. Cl. ..... 62/612; 62/623

[58] Field of Search ..... 62/612, 623

[56] References Cited

U.S. PATENT DOCUMENTS

| | | | |
|---|---|---|---|
| 3,364,685 | 1/1968 | Perrett . | |
| 3,855,810 | 12/1974 | Simon et al. . | |
| 3,914,949 | 10/1975 | Maher et al. . | |
| 3,932,154 | 1/1976 | Coers et al. . | |
| 4,033,735 | 7/1977 | Swenson . | |
| 4,251,247 | 2/1981 | Gauberthier et al. | 62/612 |
| 4,303,427 | 12/1981 | Krieger . | |
| 4,339,253 | 7/1982 | Caetani et al. | 62/612 |
| 4,486,210 | 12/1984 | Gauthier . | |
| 4,504,296 | 3/1985 | Newton et al. | 62/612 |
| 4,525,185 | 6/1985 | Newton | 62/612 |
| 4,539,028 | 9/1985 | Paradowski et al. . | |
| 4,586,942 | 5/1986 | Gauthier . | |
| 4,755,200 | 7/1988 | Liu et al. | 62/612 |
| 5,036,671 | 8/1991 | Nelson et al. . | |
| 5,139,548 | 8/1992 | Liu . | |
| 5,157,925 | 10/1992 | Denton et al. | 62/612 |
| 5,363,655 | 11/1994 | Kikkawa et al. . | |
| 5,365,740 | 11/1994 | Kikkawa . | |
| 5,535,594 | 7/1996 | Grenier | 62/612 |

*Primary Examiner*—Christopher Kilner
*Attorney, Agent, or Firm*—F. Lindsey Scott

[57] ABSTRACT

An improved closed loop single mixed refrigerant process and system for cooling a fluid material through a temperature range exceeding 200° F. by heat exchange with a single mixed refrigerant in a closed loop refrigeration cycle comprising: compressing the mixed refrigerant in a first stage compressor; cooling the compressed mixed refrigerant from the first stage compressor to produce a first mixture of a first condensed portion of the mixed refrigerant, and a gaseous refrigerant; separating the first condensed portion of the mixed refrigerant from the gaseous refrigerant; passing the gaseous refrigerant to a second stage compressor and further compressing the gaseous refrigerant; cooling the second stage compressed gaseous refrigerant to produce a second mixture of a second condensed portion of the gaseous refrigerant and a second gaseous refrigerant; separating the second condensed portion of the gaseous refrigerant and the second gaseous refrigerant; combining the first condensed portion of the mixed refrigerant with the second condensed portion of the gaseous refrigerant and the second gaseous refrigerant; charging the compressed mixed refrigerant to a refrigeration zone where the compressed mixed refrigerant is cooled to produce a liquid, mixed refrigerant, and expanded to produce a low temperature coolant; passing the low temperature coolant in countercurrent heat exchange with the compressed mixed refrigerant and the fluid material to produce the liquid, mixed refrigerant, a cooled, liquid, fluid material and gaseous mixed refrigerant; and recycling the gaseous mixed refrigerant to the first stage compressor.

29 Claims, 2 Drawing Sheets

CLOSED LOOP SINGLE MIXED REFRIGERANT PROCESS

BACKGROUND OF THE INVENTION

Field of the Invention

This invention relates to an improved dosed loop single mixed refrigerant process wherein an improved efficiency is accomplished by the use of a cooling and liquid refrigerant separation step between a first and second stage compressor in combination with reconstitution of the mixed refrigerant prior to use of the compressed mixed refrigerant.

In recent years, the demand for natural gas has increased. In many instances, natural gas is found in areas which are remotely located from the markets for the natural gas. Unless the natural gas is located sufficiently close to a market place so that it is feasible to construct a pipeline to transport the natural gas, it must be transported by tankers or the like. The transportation of natural gas as a gas requires prohibitively large tanker volumes; therefore, the natural gas is customarily liquefied for storage and transportation. The use of liquefied natural gas is well known and methods for its storage and use are well known. Natural gas may also be liquefied at the point of use when it is available in surplus but may be needed in larger volumes than can be delivered to the point of use in the future and the like. Such storage may be used, for instance, to meet a wintertime peak demand for natural gas in excess of that available through an existing pipeline system during the winter peak demand periods or the like. Various other industrial applications require that natural gas be liquefied for storage and the like.

Other gases are liquefied with somewhat less frequency but may also be liquefied by the improved process described herein.

Previously, substances such as natural gas have been liquefied by processes such as shown in U.S. Pat. No. 4,033,735 issued Jul. 5, 1977 to Leonard K. Swenson which is hereby incorporated in its entirety by reference. In such processes, a single mixed refrigerant is used. Such processes have many advantages over other processes such as cascade systems, in that they require less expensive equipment and are less difficult to control than cascade type processes. Unfortunately, the single mixed refrigerant processes require somewhat more power than the cascade systems.

Cascade systems such as the system shown in U.S. Pat. No. 3,855,810 issued Dec. 24, 1974 to Simon, et al. basically utilize a plurality of refrigeration zones in which refrigerants of decreasing boiling points are vaporized to produce a coolant. In such systems, the highest boiling refrigerant, alone or with other refrigerants, is typically compressed, condensed and separated for cooling in a first refrigeration zone. The compressed cooled highest boiling point refrigerant is then flashed to provide a cold refrigeration stream which is used to cool the compressed highest boiling refrigerant in the first refrigeration zone. In the first refrigeration zone, some of the lower boiling refrigerants may also be cooled and subsequently condensed and passed to vaporization to function as a coolant in a second or subsequent refrigeration zone and the like. As a result, the compression is primarily of the highest boiling refrigerant and is somewhat more efficient than when the entire single mixed refrigerant stream must be compressed.

In view of the reduced equipment cost and reduced difficulty of control with the single mixed refrigerant process, a search has been directed to the development of such a process wherein the power requirements are reduced.

SUMMARY OF THE INVENTION

According to the present invention, reduced power consumption is achieved in a dosed loop single mixed refrigerant process for cooling a fluid material through a temperature range exceeding 200° F. by heat exchange with a single mixed refrigerant in a dosed loop refrigeration cycle comprising: (a) compressing the mixed refrigerant in a compressor to produce a compressed mixed refrigerant; (b) cooling the compressed mixed refrigerant to produce a mixture of a condensed portion of the mixed refrigerant and a gaseous refrigerant; (c) separating the condensed portion of the mixed refrigerant from the gaseous refrigerant; (d) combining the condensed portion of the mixed refrigerant and the gaseous refrigerant to reconstitute the mixed refrigerant; (e) charging compressed mixed refrigerant to a refrigeration zone wherein the mixed refrigerant is passed in countercurrent heat exchange with a low temperature coolant to produce a substantially liquid mixed refrigerant; (f) passing the substantially liquid mixed refrigerant through an expansion valve to produce the low temperature coolant; (g) charging the fluid material to the refrigeration zone wherein the fluid material is passed in countercurrent heat exchange with the low temperature coolant; (h) recovering the fluid material in a substantially liquid phase; (i) recovering the mixed refrigerant from the refrigeration zone in a substantially gaseous phase; and, (j) recycling the gaseous mixed refrigerant to the compressor, by an improvement comprising: (1) compressing the mixed refrigerant in a first stage compressor; (2) cooling the compressed mixed refrigerant from the first stage compressor to produce a first stage mixture of a first stage condensed liquid refrigerant rich in higher boiling point components of the mixed refrigerant and a first stage gaseous refrigerant; (3) separating the first stage condensed liquid refrigerant from the first stage gaseous refrigerant; (4) compressing the first stage gaseous refrigerant in a second stage compressor; (5) cooling the compressed first stage gaseous refrigerant to produce a second stage mixture of a second stage condensed liquid refrigerant and a second stage gaseous refrigerant; (6) separating the second stage condensed liquid refrigerant and the second stage gaseous refrigerant; (7) combining the first stage condensed liquid refrigerant, the second stage condensed liquid refrigerant and the second stage gaseous refrigerant to reconstitute the mixed refrigerant; and (8) charging compressed mixed refrigerant to the refrigeration zone.

The present invention also comprises a dosed loop single mixed refrigerant process for cooling a fluid material through a temperature range exceeding 200° F. by heat exchange with a single mixed refrigerant in a dosed loop refrigeration cycle comprising: (a) compressing the mixed refrigerant in a first stage compressor; (b) passing the compressed mixed refrigerant from the first stage compressor to a first heat exchanger to cool the mixed refrigerant and produce a first mixture of a first condensed portion of the mixed refrigerant, the first condensed portion being rich in higher boiling components of the mixed refrigerant and a gaseous refrigerant; (c) separating the first condensed portion of the mixed refrigerant from the gaseous refrigerant; (d) passing the gaseous refrigerant to a second stage compressor and further compressing the gaseous refrigerant; (e) passing the second stage compressed gaseous refrigerant to a second heat exchanger to cool the compressed gaseous refrigerant and produce a second mixture of a second condensed portion of the gaseous refrigerant and a second gaseous refrigerant; (f) separating the second condensed portion of the gaseous refrigerant and the second gaseous refrigerant; (g) combining the first condensed portion of the mixed refrigerant with the second condensed portion of the gaseous refrigerant and the second gaseous refrigerant to reconstitute the mixed refrigerant; (h) charging the mixed refrigerant to a refrigeration zone where compressed mixed refrigerant is cooled to produce a cooled, substantially liquid, mixed refrigerant, passed to an expansion valve and expanded to produce a low temperature coolant; (i) passing the low temperature coolant in countercurrent heat exchange with the mixed refrigerant and the fluid material in the refrigeration zone to produce the cooled, substantially liquid, mixed refrigerant, a cooled, substantially liquid, fluid material and gaseous mixed refrigerant; and (j) recycling the gaseous mixed refrigerant to the first stage compressor.

The invention also comprises a closed loop single mixed refrigerant system including: a) a mixed refrigerant suction drum; b) a first compressor having an inlet in fluid communication with an outlet from the mixed refrigerant suction drum; c) a first condenser having an inlet in fluid communication with an outlet from the first compressor; d) a first refrigerant separator having an inlet in fluid communication with an outlet from the first condenser; e) a second compressor having an inlet in fluid communication with a gaseous refrigerant outlet from the first refrigerant separator; f) a second condenser having an inlet in fluid communication with an outlet from the second compressor; g) a second refrigerant separator having an inlet in fluid communication with an outlet from the second condenser and a liquid refrigerant outlet from the first refrigerant separator; h) a refrigeration vessel including a first heat exchange passageway in fluid communication with a gaseous refrigerant outlet from the second refrigerant separator and a liquid refrigerant outlet from the second refrigerant separator, a second heat exchange passageway in fluid communication with a source of a fluid material which is to be cooled, a third heat exchange passageway countercurrently positioned in the refrigeration vessel with respect to the first heat exchange passageway, and an expansion valve in fluid communication with an outlet from the first heat exchange passageway and an inlet to the third heat exchange passageway; and the second heat exchange passageway; i) a recycled refrigerant line in fluid communication with an outlet from the third heat exchange passageway and an inlet to the mixed refrigerant suction drum; and, j) a product line in fluid communication with an outlet from the second heat exchange passageway.

DESCRIPTION OF THE PREFERRED EMBODIMENT

In the description of the figures, the same numbers will be used to refer to corresponding elements throughout. Not all valves, pumps and the like necessary to achieve the desired flows have been shown, since they are not necessary to the description of the present invention.

Figure 1:
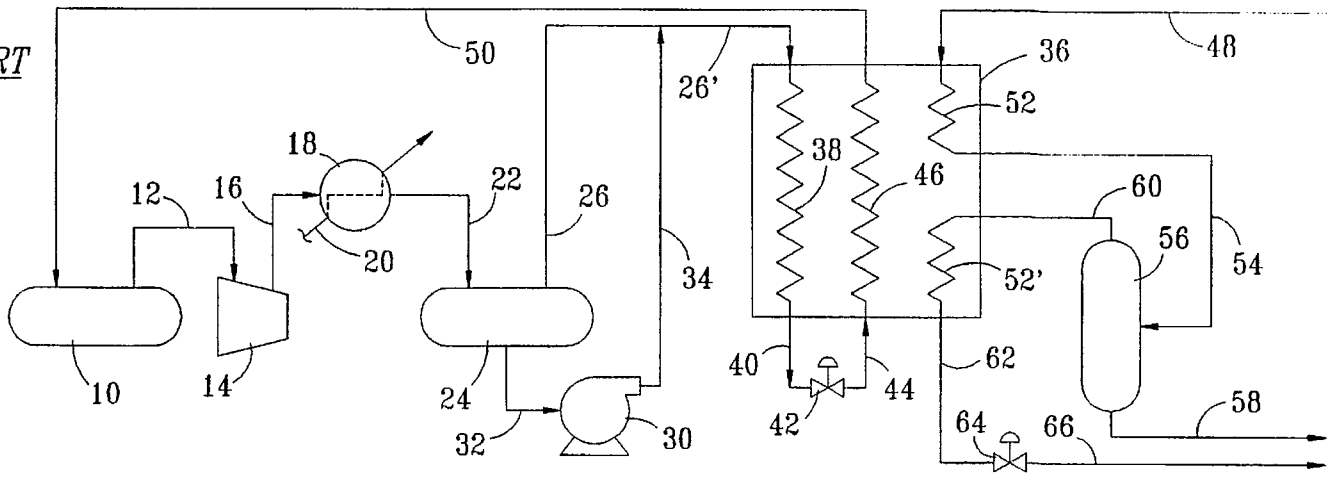
FIG. 1 PRIOR ART
FIG. 1 is a schematic diagram of a prior art closed loop single mixed refrigerant process for the liquefaction of a dried natural gas stream.

In FIG. 1, a prior art single mixed refrigerant closed loop system is shown. Mixed refrigerant is drawn from a refrigerant suction drum 10 and passed through a line 12 to a compressor 14. In compressor 14, the mixed refrigerant is compressed and discharged through a line 16 and passed to a refrigerant condenser 18 where the mixed refrigerant is cooled by heat exchange with a coolant such as water, air or the like. The cooled compressed mixed refrigerant is then passed through a line 22 to a refrigerant separator 24 where it is separated into a liquid refrigerant portion and a gaseous refrigerant portion. The gaseous refrigerant is passed via a line 26 to a refrigerant and fluid material heat exchanger 36. The liquid refrigerant is withdrawn from the separator 24 through a line 32 and passed to a pump 30 where it is pumped through a line 34 to a junction with the line 26 where the gaseous refrigerant in the line 26 and the liquid refrigerant in the line 34 are combined to reconstitute the compressed mixed refrigerant and passed through the remaining portion of the line 26, shown as a line 26', to the heat exchanger 36. The compressed mixed refrigerant is passed through the heat exchanger 36 via a flow path 38 to a discharge line 40. The mixed refrigerant is desirably cooled in the heat exchanger 36 to a temperature at which it is completely liquid as it passes from the heat exchanger 36 into the line 40. The refrigerant in the line 40 is basically at the same pressure, less line losses resulting from its passage through the passageway 38, in line 40 as in the line 26'. The mixed refrigerant is passed through an expansion valve 42 where a sufficient amount of the liquid mixed refrigerant is flashed to reduce the temperature of the mixed refrigerant to a desired temperature. The desired temperature for natural gas liquefaction is typically from about −230° F. to about −275° F. Typically, the temperature is about −235° F. The pressure is reduced across the expansion valve 42 to a pressure from about 50 to about 75 psia. The low pressure mixed refrigerant boils as it proceeds via a flow path 46 through the heat exchanger 36 so that the mixed refrigerant is gaseous as it is discharged into a line 50. Upon discharge into the line 50, the mixed refrigerant is substantially, completely vaporized. The gaseous mixed refrigerant passed to the line 50 is passed through the line 50 to the refrigerant suction drum 10. In the event that any traces of liquid refrigerant are recovered through the line 50, they are allowed to accumulate in refrigerant suction drum 10 where they eventually vaporize and remain a part of the mixed refrigerant passed through the line 12 to the compressor 14.

The natural gas is typically dried and may have been treated for the removal of materials such as sulfur compounds, carbon dioxide and the like. The natural gas is supplied to the heat exchanger 36 through a line 48 and passes via a heat exchange path 52 through the heat exchanger 36. As shown, the natural gas stream may be withdrawn from the heat exchanger 36 through a line 54 and passed to a heavy liquid separator section 56 where hydrocarbons containing six or more carbon atoms are preferentially separated and recovered through a line 58 with the fluid material being returned from the separator 56 via a line 60 to a second portion 52' of the heat exchange path 52. In some instances, it may be desirable to remove a $C_2$–$C_5$+ stream in the separator section 56 for use as a product or for other reasons. The use and operation of a suitable heavy liquid separator section is shown in U.S. Pat. 4,033,735, previously incorporated by reference. The separation of these heavier materials from the natural gas stream is necessary in some instances when heavier materials are present in the natural gas which would otherwise freeze in the passageway 52', as the natural gas is cooled to its liquid phase. Such compounds which could solidify in the path 52' are removed in the heavy liquid separator 56. In the event that no such heavy materials are present, or if a sufficiently small quantity of such heavy materials is present, so that no precipitation of the solid materials occurs in the pathway 52', the natural gas stream may be liquefied in the heat exchanger 36 without treatment for the removal of heavy hydrocarbons.

The liquefied natural gas is recovered from the heat exchanger 36 through a line 62 at a temperature typically from about −230° F. to about −275° F. The liquefied natural gas is then passed through the line 62 to an expansion valve 64 where the liquefied natural gas flashes to a lower pressure which lowers the liquefied natural gas temperature to about −260° F. at a pressure of one atmosphere. At this temperature, the liquefied natural gas is suitably stored and maintained as a liquid at atmospheric pressure. Such a process is described in U.S. Pat. No. 4,033,735, previously incorporated by reference.

Figure 2:
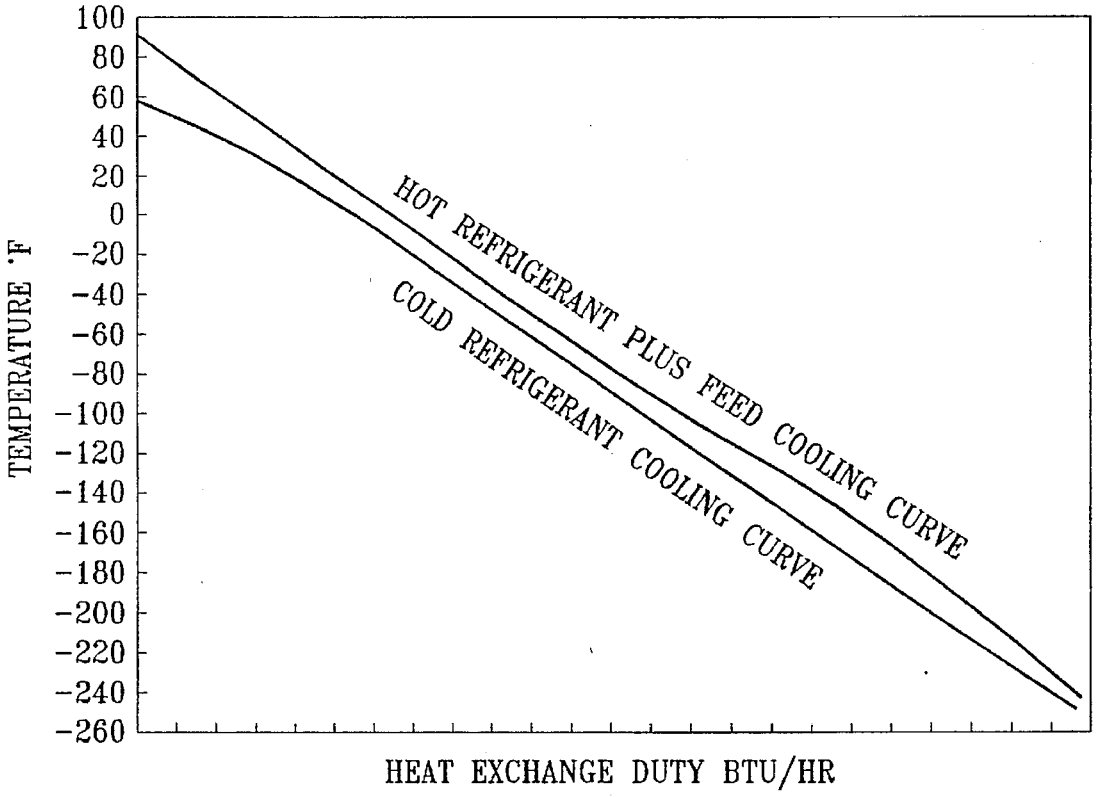
FIG. 2 PRIOR ART
FIG. 2 is a prior art graph of a cold refrigerant cooling curve and a hot refrigerant plus feed cooling curve for a dosed loop single mixed refrigerant process wherein dried natural gas is the feed stream.

In FIG. 2, a heat exchange curve showing the cold refrigerant cooling curve and the hot refrigerant plus feed cooling curve is shown. Desirably, the curves are kept close in the lower temperature ranges since the removal of heat at the lower temperatures is considerably more expensive than the removal of heat at the higher temperatures. Since the components of the natural gas and the mixed refrigerant are somewhat similar, it is possible to adjust the cooling curve by adding or removing components from the mixed refrigerant. Desirably, the temperature curves diverge at the upper end of the cooling temperature range. The desirability of cooling along such a curve and the adjustment of the composition of the mixed refrigerant to achieve the desired cooling curves is shown in U.S. Pat. No. 4,033,735, previously incorporated by reference. The adjustment of the refrigerant composition and the methods for controlling the refrigerant composition to achieve the desired cooling curves will not be discussed further in view of the discussion in U.S. Pat. No. 4,033,735.

Figure 3:
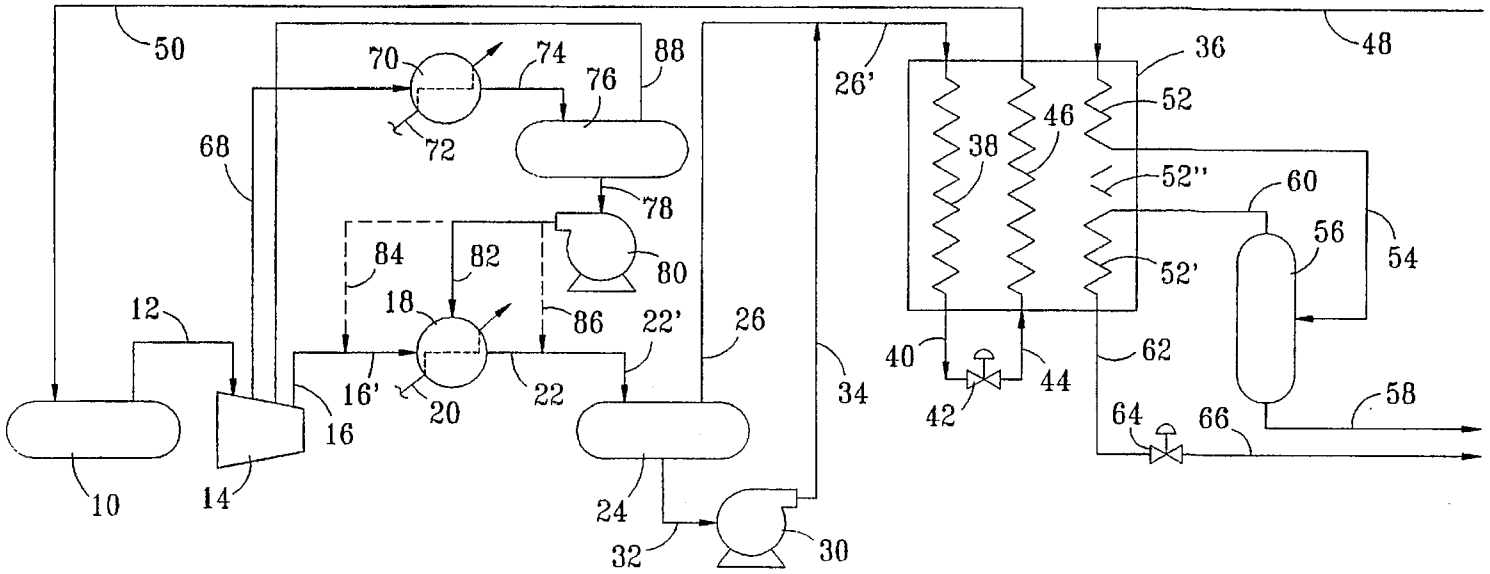
FIG. 3 is a schematic diagram of the improved closed loop single mixed refrigerant process of the present invention wherein a dried natural gas stream is cooled to produce a liquefied natural gas stream.

In FIG. 3, an embodiment of the improved single mixed refrigerant closed loop process of the present invention is shown. The mixed refrigerant withdrawn from the refrigerant suction drum 10 is passed to the compressor 14 which comprises a two-stage compressor in FIG. 3. Two separate single-stage compressors could be used rather than a two-stage compressor as known to those skilled in the art. In the first stage, the mixed refrigerant is compressed to a pressure ranging from about 100 psi to about 250 psi and typically to a pressure of about 175 psia and withdrawn in its entirety through a line 68 through which it is passed to a condenser 70 where the compressed mixed refrigerant is passed in heat exchange with a stream such as water, air or the like supplied through a line 72. The resulting cooled, compressed, mixed refrigerant is recovered through a line 74 and passed to a refrigerant separator 76. In the refrigerant separator 76, the mixed refrigerant is separated into a liquid portion and a gas portion. The gas portion is passed through a line 88 to the second stage of compressor 14 where it is further compressed to a pressure from about 450 psia to about 650 psia. The temperature in the compressed refrigerant increases as the refrigerant is compressed to higher pressures. The temperature increase is at least in part a function of the amount of energy required for the compression. The compressed refrigerant recovered from the second stage of compressor 14 is passed through the line 16 to the refrigerant condenser 18 where it is passed in heat exchange relationship with a fluid, such as water, air or the like, supplied through the line 20 to cool the compressed gaseous refrigerant. The composition of the gaseous refrigerant in the line 16 will vary from the composition of the mixed refrigerant initially charged to the compressor 14, since the liquid components removed from the mixed refrigerant in the separator 76 are no longer present. The cooled refrigerant from the refrigerant condenser 18 is passed through the line 22 to the refrigerant separator 24. The liquid refrigerant separated in the refrigerant separator 76 is recovered through a line 78 and pumped via a pump 80 through a line 82 to the refrigerant condenser 18 through a line 82, to the line 16 (as shown by dotted line 84) to produce a mixture of the two streams in the portion of the line 16 shown as a line 16', or to the line 22 (as shown by dotted line 86) to produce a combination of the two streams which flows through the portion of the line 22 shown as a line 22'. As a result, the liquid refrigerant recovered in the refrigerant separator 76 is combined with the compressed, cooled gaseous refrigerant in the refrigerant separator 24. In the refrigerant separator 24, a liquid refrigerant is separated and recovered through the line 32 and passed through the pump 30 and the line 34 to combination with the gaseous refrigerant recovered from the refrigerant separator 24 through the line 26. The combined liquid and gaseous refrigerants in the line 26 are passed through the portion of the line 26 shown as the line 26' to the refrigerant and fluid material heat exchanger 36. The heat exchanger 36 functions as discussed previously in connection with FIG. 1. The liquid and gaseous refrigerant portions of the mixed refrigerant can be mixed at any suitable point prior to use in the heat exchanger 36.

The improved process results in the removal of a portion of the mixed refrigerant in the refrigerant separator 76 prior to compression of the gaseous refrigerant to its final pressure. The liquid refrigerant removed comprises from about 5 to about 25 mole percent of the mixed refrigerant charged to the compressor 14. The liquid refrigerant separated in the refrigerant separator 76 is rich in the higher boiling components of the mixed refrigerant.

Previously, it was necessary to compress the entire mixed refrigerant mixture to its final pressure, resulting in higher energy requirements for the single mixed refrigerant closed loop refrigeration process. The entire mixture was compressed as a single stream to maintain the composition of the mixed refrigerant constant in the process.

By the process of the present invention, a portion of the mixed refrigerant is removed in the refrigerant separator 76 so that the amount of gaseous refrigerant remaining to be compressed in the second stage of the compressor 14 is reduced. Further, the gaseous refrigerant passed to the second stage of the compressor 14 is at a lower temperature than the discharge temperature from the first stage of the compressor 14. The compressed gaseous refrigerant from the refrigerant separator 76, after subsequent cooling and separation in refrigerant separator 24, is separated into a liquid portion and a gaseous portion in the separator 24. Since the liquid refrigerant recovered from the separator 24 includes the liquid refrigerant recovered from the refrigerant separator 76, the combination of these two liquid streams, in proper proportions, with the remaining gaseous components of the refrigerant in the line 26 results in the desired mixed refrigerant composition. The amount of liquid and gas combined in the line 26' is controlled to result in the composition in the line 26' being the desired mixed refrigerant composition. Since there is no refrigerant added to or subtracted from the closed loop system, the mixed refrigerant composition is achieved in the line 26' and a substantial reduction in the amount of energy required to compress the mixed refrigerant to the desired pressure is achieved. In previous processes of this type, the energy requirements have been high because the entire mixed refrigerant stream was compressed as a whole to produce the compressed mixed refrigerant passed to the heat exchanger 36 from the refrigerant separator 24.

The process described above is ideally suited for the liquefaction of natural gas. The process can be used to cool other substances, but since many of the components of the preferred mixed refrigerant and the natural gas are the same, the heat exchange curves are easily maintained in close proximity, as discussed previously. Further, components of the natural gas can be used as make-up for the mixed refrigerant if necessary.

The mixed refrigerant contains compounds selected from the group consisting of nitrogen and hydrocarbons containing from 1 to about 5 carbon atoms. In a preferred embodiment, the mixed refrigerant compresses nitrogen, methane, ethane and isopentane. In another preferred embodiment, the refrigerant contains at least 5 compounds selected from the group. The mixed refrigerant must be capable of becoming substantially liquid at the temperature in the line 40. The mixed refrigerant must also be capable of fully vaporizing by heat exchange against itself and the natural gas stream so that it is fully vaporized at the discharge from the heat exchanger 36. The refrigerant must not contain compounds which solidify in the mixed refrigerant in the heat exchanger 36. Mixed refrigerants of this type are disclosed in U.S. Pat. No. 4,033,735, previously incorporated by reference. When the material to be cooled is natural gas, the refrigerant constituents can be expected to fall in the following mole fraction percent ranges: nitrogen: 0 to about 12; $C_1$: about 20 to about 36; $C_2$: about 20 to about 40; $C_3$: about 2 to about 12; $C_4$: about 6 to about 24; and $C_5$: about 2 to about 20.

Desirably, the compressed mixed refrigerant streams in the line 16 and in the line 68 are cooled to a temperature below about 135° F. These streams are desirably cooled with materials such as water, using shell and tube heat exchangers or the like, or air, using fin fan coolers or the like. Typically, when air is used as a coolant, the streams are cooled to a temperature from about 100° F. to about 135° F., although cooler temperatures may be possible if cooler air is available. With water, the cooling is typically to temperatures from about 80° F. to about 100° F., although cooler temperatures may be achieved if cooler water is available. The cooled, compressed, mixed refrigerant is then amenable to separation into a liquid and a gaseous phase for handling, as discussed above, to reconstitute the mixed refrigerant for passage to the heat exchanger 36 for use in cooling natural gas. Heat is readily removed from these streams (lines 16 and 68) by streams which are readily available at very low cost. The heat exchanger 36 is desirably produced from brazed metal, such as aluminum, for good heat exchange.

As well known to those skilled in the art, the liquefied natural gas so produced is readily maintained in suitable storage by simply allowing small quantities of the liquefied natural gas to vaporize to maintain the temperature of the liquefied natural gas in the storage tank. By contrast to cascade systems, the present process uses a single heat exchanger 36, although a plurality of parallel or series heat exchangers could be used so long as the mixed refrigerant is used in all of the heat exchangers.

By contrast to the cascade systems, only one expansion nozzle is used in the heat exchanger 36 and a column of low pressure boiling mixed refrigerant passes countercurrently to the high pressure mixed refrigerant charged to heat exchanger 36. The mixed refrigerant vaporizes at a rate defined by its composition along the entire length of the heat exchange path. This is in direct contrast to the cascade systems wherein portions of the refrigerant having successively lower boiling points are separately vaporized in separate heat exchange sections. The heat exchange area of the path 38 for the high pressure mixed refrigerant, which is liquefied in the heat exchanger 36, is typically equal to about 35 percent of the total heat exchange area in the heat exchanger 36. The vaporizing mixed refrigerant path 46 contains about 65 percent of the heat exchange area in the heat exchanger 36 and the natural gas heat exchange path 52 contains about 5 percent of the heat exchange area. It should be noted that when the refrigerant cooling path and refrigerant vaporization path are in proper balance, variations in the natural gas stream have little effect on the operation of the heat exchanger 36, since the natural gas heat exchange path 52 is a relatively minor part of the entire heat exchange surface in heat exchanger 36.

When a dried natural gas stream at 110° F. is cooled to produce liquefied natural gas at −265° F. by the process of the present invention, the cooling is achieved with about 14 percent less horsepower than with the prior art process. This is a significant energy reduction.

Having thus described the invention by reference to its preferred embodiments, it is respectfully pointed out that the embodiments described are illustrative rather than limiting in nature and that many variations and modifications are possible within the scope of the present invention. Many such variations and modifications may appear obvious and desirable to those skilled in the art based upon a review of the foregoing description of the preferred embodiments.

Having thus described the invention, I claim:

1. A closed loop single mixed refrigerant process for cooling a fluid material through a temperature range exceeding 200° F. by heat exchange with a single mixed refrigerant in a closed loop refrigeration cycle comprising:

compressing gaseous mixed refrigerant in a first compressor;

passing the compressed gaseous mixed refrigerant from the first compressor to a first heat exchanger to cool the mixed refrigerant and produce a first mixture of a first condensed portion of the mixed refrigerant, the first condensed portion being rich in higher boiling components of the mixed refrigerant and a gaseous refrigerant;

separating the first condensed portion of the mixed refrigerant from the gaseous refrigerant;

passing the gaseous refrigerant to a second compressor and further compressing the gaseous refrigerant to produce a second compressed gaseous refrigerant;

passing the second compressed gaseous refrigerant to a second heat exchanger to cool the compressed gaseous refrigerant and produce a second mixture of a second condensed portion of the gaseous refrigerant and a second gaseous refrigerant separating the second condensed portion of the gaseous refrigerant and the second gaseous refrigerant;

combining the first condensed portion of the mixed refrigerant with the second condensed portion of the gaseous refrigerant and the second gaseous refrigerant to reconstitute the mixed refrigerant;

charging compressed mixed refrigerant to a refrigeration zone where the compressed mixed refrigerant is cooled to produce a cooled, substantially liquid, mixed refrigerant, passed to an expansion valve and expanded to produce a low temperature coolant;

passing the low temperature coolant in countercurrent heat exchange with the compressed mixed refrigerant and the fluid material in the refrigeration zone to produce the cooled, substantially liquid, mixed refrigerant, a cooled, substantially liquid, fluid material and gaseous mixed refrigerant; and recycling the gaseous mixed refrigerant to the first stage compressor.

2. The process of claim 1 wherein the fluid material is natural gas.

3. The process of claim 2 wherein the mixed refrigerant contains compounds selected from the group consisting of nitrogen and hydrocarbons containing from 1 to about 5 carbon atoms.

4. The process of claim 3 wherein the mixed refrigerant comprises nitrogen, methane, ethane and isopentane.

5. The process of claim 2 wherein the mixed refrigerant is compressed to a pressure from about 100 to about 250 psia in the first stage compressor.

6. The process of claim 3 wherein the compressed mixed refrigerant from the first stage compressor is cooled to a temperature below about 135° F.

7. The process of claim 2 wherein the first condensed portion is equal to from about 5 to about 25 mole percent of the mixed refrigerant.

8. The process of claim 2 wherein the gaseous refrigerant is compressed to a pressure from about 450 psia to about 650 psia in the second stage compressor.

9. The process of claim 2 wherein the compressed gaseous refrigerant from the second compressor is cooled to a temperature below about 135° F.

10. The process of claim 2 wherein the cooled compressed gaseous refrigerant from the second compressor is separated into a liquid portion and a gaseous portion.

11. The process of claim 10 wherein the liquid portion, the gaseous portion and the first condensed portion are combined to produce the compressed mixed refrigerant.

12. The process of claim 3 wherein the natural gas is:

a) withdrawn from the refrigeration zone;

b) passed to a heavy liquids separation zone wherein at least a major portion of natural gas constituents containing six or more carbon atoms are removed from the natural gas; and c) returned to the refrigeration zone.

13. The process of claim 2 wherein the liquefied natural gas is recovered from the refrigeration zone at a temperature from about −230° F. to about −275° F.

14. The process of claim 1 wherein the first stage compressor and the second stage compressor comprise a first compressor and a second compressor.

15. In a closed loop single mixed refrigerant process for cooling a fluid material through a temperature range exceeding 200° F. by heat exchange with a single mixed refrigerant in a closed loop refrigeration cycle comprising:

compressing gaseous mixed refrigerant in a compressor to produce a compressed mixed refrigerant;

Cooling the compressed mixed refrigerant to produce a mixture of a condensed portion of the mixed refrigerant and a gaseous refrigerant;

separating the condensed portion of the mixed refrigerant;

combining the condensed portion of the mixed refrigerant and the gaseous refrigerant to reconstitute the mixed refrigerant;

charging the mixed refrigerant to a refrigeration zone wherein the mixed refrigerant is passed in countercurrent heat exchange with a low temperature coolant to produce a substantially liquid mixed refrigerant;

passing the substantially liquid mixed refrigerant through an expansion valve to produce the low temperature coolant;

charging the fluid material to the refrigeration zone wherein the fluid material is passed in countercurrent heat exchange with the low temperature coolant;

recovering the fluid material in a substantially liquid phase;

recovering the mixed refrigerant after the countercurrent heat exchange in a substantially gaseous phase; and recycling the gaseous mixed refrigerant to the compressor, the improvement comprising;

compressing the gaseous mixed refrigerant in a first stage compressor;

cooling the compressed mixed refrigerant from the first stage compressor to produce a first stage mixture of a first stage condensed liquid refrigerant rich in higher boiling point components of the mixed refrigerant and a first stage gaseous refrigerant;

separating the first stage condensed liquid refrigerant from the first stage gaseous refrigerant;

compressing the first stage gaseous refrigerant in a second stage compressor;

cooling the compressed first stage gaseous refrigerant to produce a second stage mixture of a second stage ;condensed liquid refrigerant and a second stage gaseous refrigerant;

separating the second stage condensed liquid and the second stage gaseous refrigerant;

combining the first stage condensed liquid refrigerate, the second stage condensed liquid refrigerant and the second stage gaseous refrigerant to reconstitute the compressed mixed refrigerant; and charging the compressed, reconstituted, mixed refrigerant to the refrigeration zone.

16. The improvement of claim 15 wherein the fluid material is natural gas.

17. The improvement of claim 15 wherein the mixed refrigerant contains compounds selected from the group consisting of nitrogen and hydrocarbons containing from 1 to about 5 carbon atoms.

18. The improvement of claim 17 wherein the mixed refrigerant comprises nitrogen, methane, ethane and isopentane.

19. The improvement of claim 17 wherein the mixed refrigerant is compressed to a pressure from about 100 to about 250 psia in the first stage compressor.

20. The improvement of claim 17 wherein the first stage condensed liquid refrigerant is equal to from about 5 to about 25 mole percent of the mixed refrigerant.

21. The improvement of claim 15 wherein the first stage gaseous refrigerant is compressed to a pressure from about 450 psia to about 650 psia in the second stage compressor.

22. The improvement of claim 15 wherein the natural gas is:

a) withdrawn from the refrigeration zone;

b) passed to a heavy liquids separation zone wherein at least a major portion natural gas constituents containing six or more carbon atoms are removed from the natural gas; and c) returned to the refrigeration zone.

23. The improvement of claim 15 wherein the liquefied natural gas is recovered from the refrigeration zone at a temperature from about −230° F. to about −275° F.

24. The improvement of claim 15 wherein the first stage compressor and the second stage compressor comprise a first compressor and a second compressor.

25. A closed loop single mixed refrigerant system comprising:

a) a mixed refrigerant suction drum;

b) a first compressor having an inlet in fluid communication with a gaseous mixed refrigerant outlet from the mixed refrigerant storage drum;

c) a first condenser having an inlet in fluid communication with an outlet from the first compressor;

d) a first refrigerant separator having an inlet in fluid communication with an outlet from the first condenser;

e) a second compressor having an inlet in fluid communication with a gaseous refrigerant outlet from the first refrigerant separator;

f) a second condenser having an inlet in fluid communication with an outlet from the second compressor;

g) a second refrigerant separator having an inlet in fluid communication with an outlet from the second condenser and a liquid refrigerant outlet from the first refrigerant separator;

h) a refrigeration vessel including a first heat exchange passageway in fluid communication with a gaseous refrigerant outlet from the second refrigerant separator and a liquid refrigerant outlet from the second refrigerant separator, a second heat exchange passageway in fluid communication with a source of a fluid material which is to be cooled, a third heat exchange passageway countercurrently positioned in the refrigeration vessel with respect to the first heat exchange passageway and the second heat exchange passageway, and an expansion valve in fluid communication with an outlet from the first heat exchange passageway and an inlet to the third heat exchange passageway;

i) a recycled refrigerant line in fluid communication with an outlet from the third heat exchange passageway and an inlet to the mixed refrigerant suction drum; and, j) a product line in fluid communication with an outlet from the second heat exchange passageway.

26. The system of claim 25 wherein the first compressor and the second compressor comprise a two stage compressor.

27. The system of claim 25 wherein the liquid refrigerant outlet from the first refrigerant separator is in fluid communication with the inlet to the second refrigerant separator via the second condenser.

28. The system of claim 25 wherein at least a portion of the fluid material is withdrawn from an intermediate portion of the second heat exchange passageway, passed to a heavy liquids removal section and returned to the second heat exchange passageway after removal of heavy liquids.

29. The system of claim 25 wherein the fluid material in the product line is passed through an expansion value to further cool the fluid material.

* * * * *

UNITED STATES PATENT AND TRADEMARK OFFICE

CERTIFICATE OF CORRECTION

PATENT NO. : 5,657,643
DATED : August 19, 1997
INVENTOR(S) : Brian C. Price

It is certified that error appears in the above-indentified patent and that said Letters Patent is hereby corrected as shown below:

At column 1, line 7; column 2, lines 3, 6, 47 and 50, please change the word "dosed" to the word "closed".

At column 7, line 17, please change the word "compresses" to the word "comprises".

At column 11, line 9, (claim 25) please change the word "storage" to the word "suction".

Signed and Sealed this

Sixth Day of January, 1998

*Attest:*

*Attesting Officer*

BRUCE LEHMAN

*Commissioner of Patents and Trademarks*